US005207064A

United States Patent [19]

Ciokajlo et al.

[11] Patent Number: 5,207,064

[45] Date of Patent: May 4, 1993

[54] STAGED, MIXED COMBUSTOR ASSEMBLY HAVING LOW EMISSIONS

[75] Inventors: John J. Ciokajlo, Cincinnati; Willard J. Dodds, West Chester, both of Ohio

[73] Assignee: General Electric Company, Cincinnati, Ohio

[21] Appl. No.: 617,236

[22] Filed: Nov. 21, 1990

[51] Int. Cl.[5] ..... F02C 3/00; F23R 3/20; F23R 3/34

[52] U.S. Cl. ..... 60/737; 60/746; 60/749

[58] Field of Search ..... 60/39.33, 733, 739, 60/743, 746, 747, 748, 749, 261, 264

[56] References Cited

U.S. PATENT DOCUMENTS

| | | | |
|---|---|---|---|
| 2,780,060 | 2/1957 | Griffith . | |
| 2,999,359 | 9/1961 | Murray | 60/737 |
| 3,020,718 | 2/1962 | Deacon et al. . | |
| 3,037,351 | 6/1962 | Stoltz . | |
| 3,048,014 | 8/1962 | Schmidt | 60/746 |
| 3,460,345 | 8/1969 | Greenwood . | |
| 3,670,497 | 6/1972 | Sheldon . | |
| 3,788,065 | 1/1974 | Markowski | 60/737 |
| 3,905,192 | 9/1975 | Pierce et al. | 60/39.71 |
| 3,930,369 | 1/1976 | Verdouw | 60/39.65 |
| 3,937,007 | 2/1976 | Kappler | 60/39.06 |
| 3,937,008 | 2/1976 | Markowski et al. | 60/733 |
| 3,973,390 | 8/1976 | Jeroszko | 60/39.06 |
| 3,999,378 | 12/1976 | Talem, Jr. et al. | 60/737 |
| 4,006,589 | 2/1977 | Schirmer | 60/39.02 |
| 4,012,904 | 3/1977 | Nogle | 60/39.65 |
| 4,078,377 | 3/1978 | Owens et al. | 60/39.23 |
| 4,112,676 | 9/1978 | DeCorso | 60/39.71 |
| 4,138,842 | 2/1979 | Zwick | 60/39.23 |
| 4,168,609 | 9/1979 | Greenberg et al. | 60/746 |
| 4,222,232 | 9/1980 | Robinson | 60/737 |
| 4,339,924 | 7/1982 | White et al. | 60/733 |
| 4,445,339 | 5/1984 | Davis, Jr. et al. | 60/749 |
| 4,586,328 | 5/1986 | Howald | 60/39.29 |
| 4,587,809 | 5/1986 | Ohmori et al. | 60/737 |
| 4,698,963 | 10/1987 | Taylor | 60/39.06 |

OTHER PUBLICATIONS

Carlstrom, L. A. et al., "Improved Emissions Performance in Today's Combustion System" AEG/SOA 7805, Jun. 1978, pp. 17-19.

D. L. Burrus et al., Energy Efficient Engine—Combustion System Component Technology Development Report, NASA Report R82AEB401, Nov. 1982, pp. cover, title 1-37.

*Primary Examiner*—Richard A. Bertsch
*Assistant Examiner*—Timothy S. Thorpe
*Attorney, Agent, or Firm*—Jerome C. Squillaro; James P. Davidson

[57] ABSTRACT

A combustion assembly includes a combustor having inner and outer pilot liners, each being in the form of a lobed mixer having outer and inner cold and hot chutes. A plurality of carburetors are joined to a dome disposed at upstream ends of the liners for providing a pilot fuel-/air mixture for generating pilot combustion gases in the hot chutes. A plurality of fuel spraybars are disposed downstream from the carburetors and are aligned radially with the cold chutes for selectively injecting main fuel into main airflow for generating a main fuel-/air mixture ignitable by the pilot combustion gases. In a preferred and exemplary embodiment of the invention, lean combustion gases are obtained for reducing $NO_x$ emissions in a relatively short residence time.

28 Claims, 7 Drawing Sheets

STAGED, MIXED COMBUSTOR ASSEMBLY HAVING LOW EMISSIONS

TECHNICAL FIELD

The present invention relates generally to gas turbine engines, and, more specifically, to a combustion assembly effective for reducing $NO_x$ emissions.

BACKGROUND ART

Commercial, or civil, aircraft are conventionally designed for reducing exhaust emissions from combustion of hydrocarbon fuel such as, for example, Jet-A fuel. The exhaust emissions may include hydrocarbon particulate matter, in the form of smoke, for example, carbon monoxide, and nitrogen oxide ($NO_x$) such as, for example, nitrogen dioxide $NO_2$. $NO_x$ emissions are known to occur from combustion at relatively high temperatures, for example over 3,000° F. (1648° C). These temperatures occur when fuel is burned at fuel/air ratios at or near stoichiometric, or, alternatively, at or near an equivalence ratio of 1.0, which represents actual fuel-air ratio divided by the stoichiometric fuel-air ratio. The amount of emissions formed is directly related to the time, i.e. residence time, that combustion takes place at these conditions.

Conventional gas turbine engine combustors for use in an engine for powering an aircraft are conventionally sized and configured for obtaining varying fuel/air ratios during the varying power output requirements of the engine such as, for example, lightoff, idle, takeoff, and cruise modes of operation of the engine in the aircraft. At relatively low power modes, such as at lightoff and idle, a relatively rich fuel/air ratio is desired for initiating combustion and maintaining stability of the combustion. At relatively high power modes, such as for example cruise operation of the engine in the aircraft, a relatively lean fuel/air ratio is desired for obtaining reduced exhaust emissions.

In the cruise mode, for example, where an aircraft gas turbine engine operates for a substantial amount of time, conventional combustors are typically sized for obtaining combustion at generally stoichiometric fuel/air ratios in the dome region, which represents theoretically complete combustion. However, in practical applications, exhaust emissions nevertheless occur, and conventional combustors utilize various means for reducing exhaust emissions.

Furthermore, it is generally desirable to have combustors which are as short as possible for reducing the overall weight of the combustor and gas turbine engine, as well as reducing parasitic cooling air requirements thereof. However, combustion gases discharged from the combustor must be provided to a conventional turbine disposed downstream thereof at relatively uniform temperature without undesirable hot streaks which would adversely affect the life of the turbine. Relatively uniform combustion gas exit temperatures are typically obtained by providing dilution air which is mixed with the hot combustion gases and undergoes mixing over a finite length of the combustor. Accordingly, the combustor must be sufficiently long for allowing such mixing to take place for obtaining relatively uniform temperatures.

OBJECTS OF THE INVENTION

Accordingly, one object of the present invention is to provide a new and improved combustion assembly for a gas turbine engine.

Another object of the present invention is to provide a combustion assembly effective for reducing $NO_X$ emissions.

Another object of the present invention is to provide a combustion assembly effective for operating over a broad range of engine power conditions.

Another object of the present invention is to provide a combustion assembly which is relatively short and lightweight.

Another object of the present invention is to provide a combustion assembly having improved means for mixing combustion gases and airflow.

DISCLOSURE OF INVENTION

A combustion assembly includes a combustor having inner and outer pilot liners, each being in the form of a lobed mixer having outer and inner cold and hot chutes. A plurality of carburetors are joined to a dome disposed at upstream ends of the liners for providing a pilot fuel-/air mixture for generating pilot combustion gases in the hot chutes. A plurality of fuel spraybars are disposed downstream from the carburetors and are aligned radially with the cold chutes for selectively injecting main fuel into main airflow for generating a main fuel-/air mixture ignitable by the pilot combustion gases. In a preferred and exemplary embodiment of the invention, lean combustion gases are obtained for reducing $NO_x$ emissions in a relatively short residence time.

BRIEF DESCRIPTION OF THE DRAWINGS

The novel features believed characteristic of the invention are set forth and differentiated in the claims. The invention, in accordance with preferred and exemplary embodiments, together with further objects and advantages thereof, is more particularly described in the following detailed description taken in conjunction with the accompanying drawing in which:

MODE(S) FOR CARRYING OUT THE INVENTION

Figure 1:
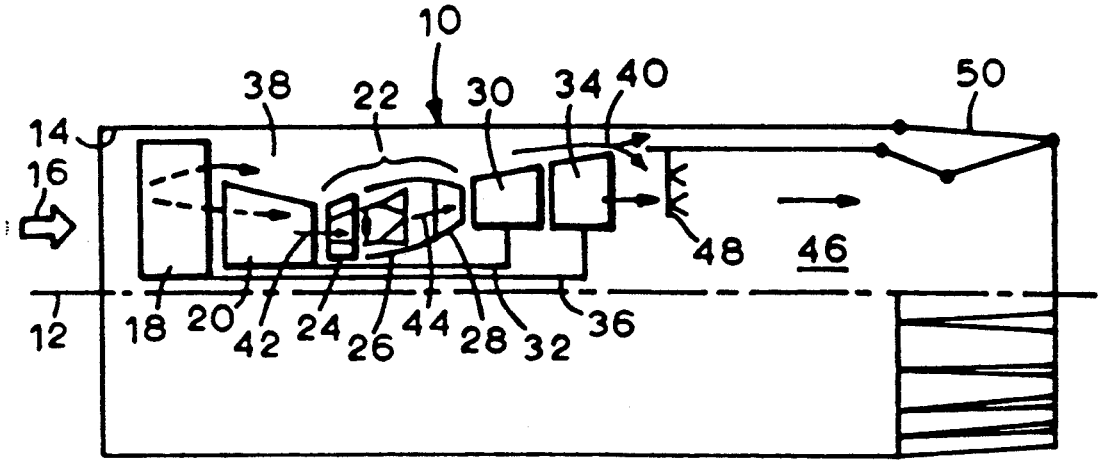
FIG. 1 is a longitudinal centerline sectional schematic view of a turbofan gas turbine engine including a combustion assembly in accordance with one embodiment of the present invention.

Illustrated in FIG. 1 is an exemplary turbofan gas turbine engine 10 for powering an aircraft during conventional modes of operation including for example, lightoff, idle, takeoff, cruise and approach. Although an aircraft gas turbine engine 10 is disclosed, the invention is also applicable to marine and industrial gas turbine engines. Disposed concentrically about a longitudinal centerline axis 12 of the engine 10 in serial flow communication is a conventional inlet 14 for receiving ambient air 16, a conventional fan 18, and a conventional high pressure compressor (HPC) 20. Disposed in flow communication with the HPC 20 is a mixer combustion assembly 22 in accordance with a preferred and exemplary embodiment of the present invention. The combustion assembly 22 includes a diffuser 24 in flow communication with the HPC 20, followed by a combustor 26 and a high pressure turbine nozzle (HPN) 28.

Disposed downstream of and in flow communication with the HPN 28 is a conventional high pressure turbine (HPT) 30 for powering the HPC 20 through a conventional HP shaft 32 extending therebetween. A conventional low pressure turbine (LPT) 34 is disposed downstream of and in flow communication with the HPT 30 for powering the fan 18 through a conventional LP shaft 36 extending therebetween. A conventional bypass duct 38 surrounds the HPC 20, combustion assembly 22, HPT 30, and LPT 34 for channeling a portion of the ambient air 16 compressed in the fan 18 as bypass air 40.

A portion of the air 16 which is not bypassed, is channeled into the HPC 20 which generates compressed airflow 42 which is discharge from the HPC 20 into the diffuser 24. The compressed airflow 42 is mixed with fuel as further described hereinbelow and ignited in the combustor 26 for generating combustion gases 44 which are channeled through the HPT 30 and the LPT 34 and discharged into a conventional afterburner, or augmentor, 46 extending downstream from the LPT 34. The augmentor 46 is optional and may be incorporated in the engine 10 if required by the particular engine cycle.

In a dry mode of operation, the afterburner 46 is deactivated and the combustion gases 44 are simply channeled therethrough. In a wet, or activated, mode of operation, additional fuel is mixed with the combustion gases 44 and the bypass air 40 in a conventional fuel injector/flameholder assembly 48 and ignited for generating additional thrust from the engine 10. The combustion gases 44 are discharged from the engine 10 through a conventional variable area exhaust nozzle 50 extending downstream from the afterburner 46.

Figure 2:
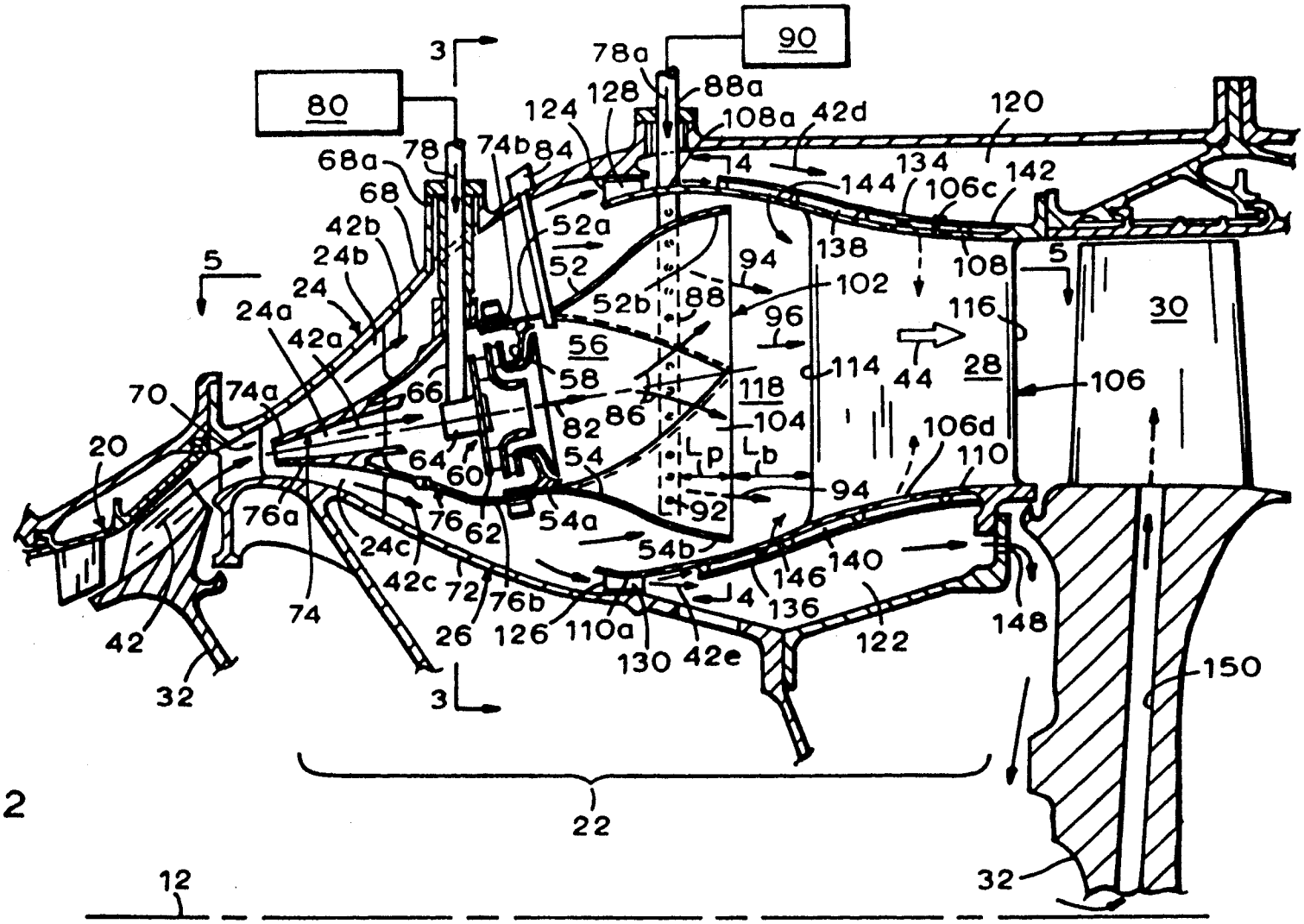
FIG. 2 is an enlarged centerline sectional view, partly schematic, of the combustion assembly illustrated in FIG. 1.
Figure 3:
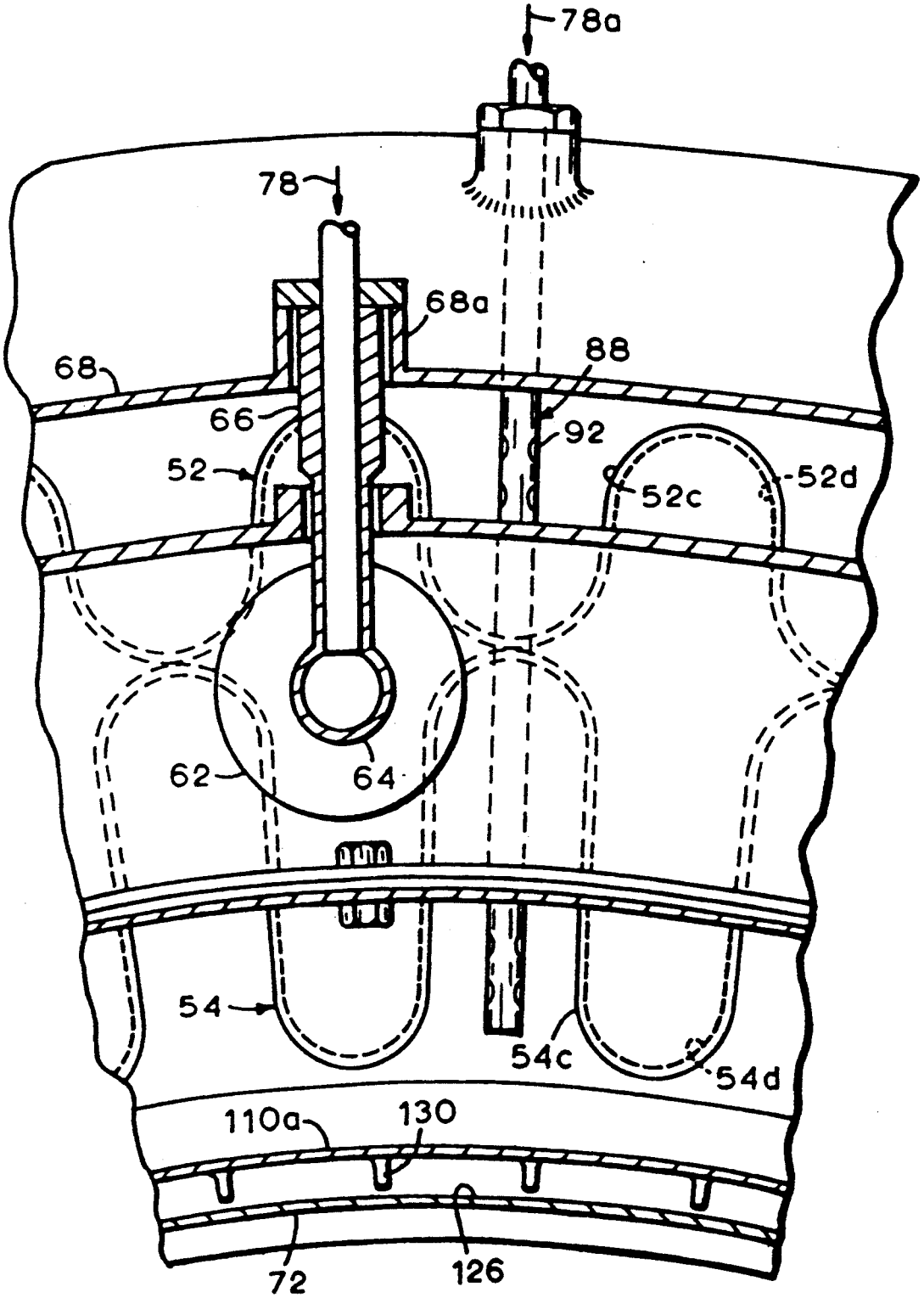
FIG. 3 is a downstream facing sectional view of a portion of the combustor illustrated in FIG. 2 taken along line 3—3.

Illustrated in more particularity in FIG. 2 is the combustion assembly 22 in accordance with a preferred and exemplary embodiment of the present invention. The combustor 26 includes an annular outer pilot liner 52 having an upstream end 52*a* and a downstream end 52*b*, and an annular inner pilot liner 54 having an upstream end 54*a* and a downstream end 54*b*, both liners 52 and 54 being disposed coaxially about the longitudinal centerline 12. The longitudinal centerline 12 is a centerline for both the engine 10 as well as the combustor 26. The inner pilot liner 54 is spaced radially inwardly from the outer pilot liner 52 to define therebetween an annular pilot combustion zone 56.

A conventional annular dome 58 conventionally fixedly joins together the inner and outer pilot liner upstream ends 52*a* and 54*a*, and includes a plurality of conventional carburetors 60 joined thereto. Each of the carburetors 60 includes a conventional counterrotational air swirler 62 fixedly connected to the dome 58, by brazing for example, and a respective airblast type fuel injector 64, although duplex-type fuel injectors could also be used. In this embodiment of the present invention, the fuel injector 64 is preferably fixedly attached to the swirler 62, for example by being formed integrally therewith, in order to support the dome 58 and pilot liners 52 and 54. More specifically, each of the fuel injectors 64 is formed integrally with a radially extending hollow fuel stem 66, which fuel stem 66 is fixedly connected to an annular outer casing 68 radially surrounding the combustor 26. Alternatively, the dome 58 and pilot liners 52 and 54 could be conventionally supported by forward pins, for example, with the fuel injector 64 being conventionally slidably supported to the swirler 62 for axial and radial movement.

The diffuser 24 includes a plurality of circumferentially spaced outlet guide vanes (OGVs) 70 extending from the outer casing 68 radially inwardly to an annular inner casing 7 which is spaced radially inwardly from the combustor 26. An annular outer cowl 74 extends upstream from the outer pilot liner 52 and includes an upstream end 74*a* formed integrally with the OGVs 70, and a downstream end 74*b* conventionally fixedly connected, by bolts, for example to the outer pilot liner upstream end 54*a*. An annular inner cowl 76 extends upstream from the inner pilot liner 54 and includes an upstream end 76*a* also formed integrally with the OGVs 70, and a downstream end 76*b* fixedly connected, by bolting, for example to the inner pilot liner upstream end 54*a*.

The outer and inner cowl upstream ends 74*a* and 76*a* are radially spaced from each other and from the outer and inner casings 68 and 72 to define a central diffuser 24*a*, an outer diffuser 24*b* and an inner diffuser 24*c*. A pilot airflow portion 42*a* of the compressed airflow 42 is diffused through the central diffuser 24*a* and channeled through the swirlers 62. Conventional liquid pilot fuel 78 is selectively provided through the fuel injector 64 from a conventional fuel supply and control 80. The pilot fuel 78 and the pilot airflow 42*a* form a pilot fuel-/air mixture 82 which is discharged from the carburetors 60 into the pilot combustion zone 56 where it is initially ignited by a conventional igniter 84 for generating pilot combustion gases 86.

Figure 4:
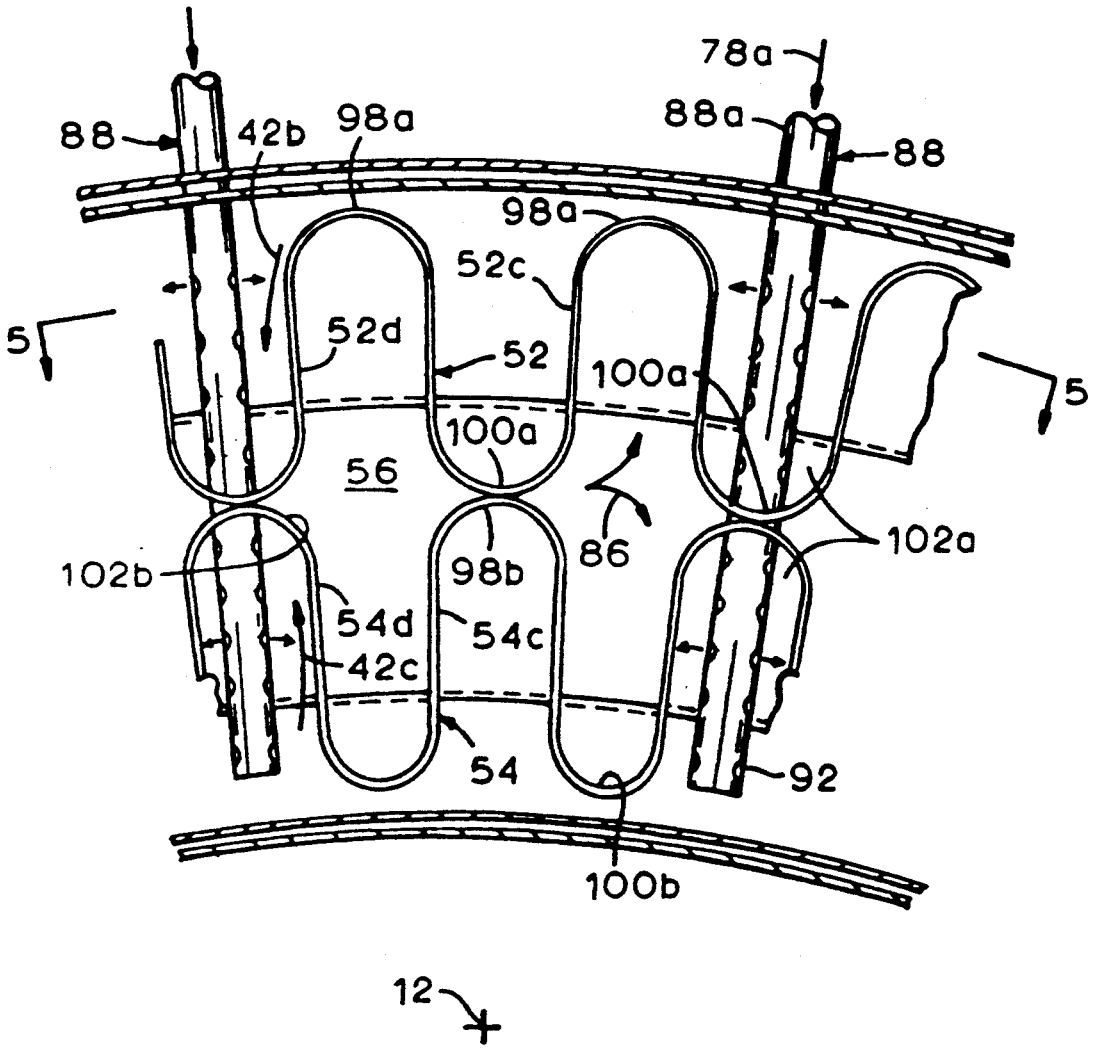
FIG. 4 is an upstream facing sectional view of a portion of the combustor illustrated in FIG. 2 taken along line 4—4.

As illustrated in more particularity in FIG. 4, each of the outer and inner pilot liners 52 and 54 is in the form of a conventional daisy, or lobed, mixer having outer and inner cold chutes 52*c* and 54*c*, respectively, in flow communication with outer and inner main airflow portions 42*b* and 42*c*, respectively, of the compressed airflow 42; and outer and inner hot chutes 52*d* and 54*d*, respectively, which define the pilot combustion zone 56 for channeling the pilot combustion gases 86.

In accordance with the preferred embodiment of the present invention, a plurality of circumferentially spaced fuel spraybars 88, as illustrated in FIGS. 2 and 4, are disposed downstream from the carburetors 60. Each of the spraybars 88 includes a proximal end 88*a* conventionally fixedly connected to the outer casing 68, and a distal end 88*b* disposed in the radially inner end of the inner cold chute 54*c*. The spraybars 88 may be conventional spraybars typically utilized in conventional afterburners of gas turbine engines. Main fuel 78*a*, which may be the same type as the pilot fuel 78, is selectively channeled through the spraybars 88 from a conventional fuel supply and control 90 and is discharged from the spraybars 88 through a plurality of radially spaced fuel outlets 92.

In one embodiment of the invention, there are eighteen carburetors 60 and forty-eight spraybars 88. And, each of the outer and inner liners 52 and 54 include forty-eight cold chutes 52*c*, 54*c* and forty-eight hot chutes 52*d*, 54*d*, respectively. The number of carburetors 60, spraybars 88, cold chutes 52*c*, 54*c*, and hot chutes 52*d*, 54*d* may be varied depending upon particular engine size. Preferably, there are two spraybars 88 for each carburetor 60, one on each side thereof. And, a spraybar 88 is also preferably located in each cold chute 52*c*, 54*c* or downstream thereof as in the alternate embodiments disclosed below.

The spraybars 88 preferably extend radially inwardly from the outer casing 68 and are preferably aligned radially with and inside the cold chutes 52*c* and 54*c* for selectively injecting the main fuel 78*a* into the main airflows 42*b* and 42*c* for generating main fuel/air mixtures 94 which are ignitable by the pilot combustion gases 56 for forming main combustion gases 96. The pilot combustion gases 56 and the main combustion gases 96 collectively define the combustion gases 44 discharged from the combustor 26. The pilot combustion gases 56 provide an effective ignition source for igniting the main fuel/air mixture 94 for providing more rapid and more complete combustion of both the pilot combustion gases 56 themselves and the main fuel/air mixture 94 as described in more detail hereinbelow.

Referring again to FIGS. 2 and 4, the outer pilot liner 52 includes a serpentine circumference about the longitudinal centerline 12 having circumferentially spaced peaks 98*a* and valleys 100*a*. Similarly, the inner pilot liner 54 includes a serpentine circumference having circumferentially spaced inner peaks 98*b* and inner valleys 100*b*. The outer and inner pilot liner downstream ends 52*b* and 54*b* define a mixer outlet, or exit plane, 102 wherein the outer pilot liner valleys 100*a* are aligned radially with and disposed adjacent to respective ones of the inner pilot liner peaks 98*b*. In the preferred embodiment, the outer valleys 100*a* and the inner peaks 98*b* are disposed closely adjacent to each other for substantially preventing the hot pilot combustion gases 86 from flowing therebetween.

The outer and inner pilot liners 52 and 54 are effective for mixing the main fuel/air mixture 94 with the pilot combustion gases 56 beginning immediately downstream of the mixer outlet 102. More specifically, the outer and inner cold chutes 52*c* and 54*c* define a mixer cold outlet 102*a*, and the outer and inner hot chutes 52*d* and 54*d* collectively define a mixer hot outlet 102*b* as illustrated in FIG. 4. The serpentine outer and inner pilot liner downstream ends 52*b* and 54*b* provide a relatively large shear, or mixing, surface for enhancing the mixing of the main fuel/air mixtures 94 discharged from the mixer cold outlets 102*a* with the pilot combustion gases 86 discharged from the mixer hot outlets 102*b*. This provides rapid combustion of the main fuel/air mixtures 94 and is a significant advantage for reducing the formation of $NO_x$ emissions and for reducing the overall length of the combustor 26.

In a preferred embodiment of the present invention, the fuel spraybars 88 are preferably disposed upstream of the mixer cold outlet 102*a* as illustrated in FIG. 2 to define therewith a premixing zone 104 having a length $L_p$. The premixing zone allows the main fuel 78*a* discharged from the fuel outlets 92 to mix, or premix, with the main airflows 42*b* and 42*c* flowable in the cold chutes 52*c* and 54*c*. Premixing of the main fuel 78*a* and the main airflows 42*b* and 42*c* improves the efficiency of combustion thereof for reducing $NO_x$ emissions. The degree of premixing will be determined in individual designs by the number of cold chutes 52*c*, 54*c* and the mixing length $L_p$, and will also be conventionally limited to provide acceptable autoignition margin at all operating conditions. $NO_x$ emission can be reduced by the premixing, which will also reduce flame temperature of the main combustion gases 96 and the length required for the combustion thereof.

Also in the preferred embodiment, the main fuel 78*a* is in the form of a liquid or a vapor provided by the main fuel supply 92, which may be conventionally obtained by preheating liquid fuel for forming the vapor fuel 78*a*. Alternatively, the main fuel 78*a* in the main fuel/air mixtures 94 may be injected as a liquid and vaporized before being discharged from the cold chutes 52*c* and 54*c*. fuel vaporization can be enhanced by allowing the outer and inner pilot liners 52 and 54 to become relatively hot for heating the main fuel/air mixtures 94. The outer and inner liners 52 and 54 are preferably uncooled except for the relatively cool main airflows 42*b* and 42*c* flowable thereover, and thus are heated by radiation from the pilot combustion gases 86 and the main combustion gases 96. The prevaporizing of the main fuel 78*a* improves the rate of combustion of the main fuel/air mixtures 96 for additionally reducing $NO_x$ emissions while providing complete combustion in a relatively short axial length.

To yet further increase the mixing effectiveness between the main fuel 78*a* and the main airflows 42*b* and 42*c*, the spraybar outlets 92 preferably face in a circumference direction opposite to each other, at about 180° apart as shown in FIG. 4.

Figure 5:
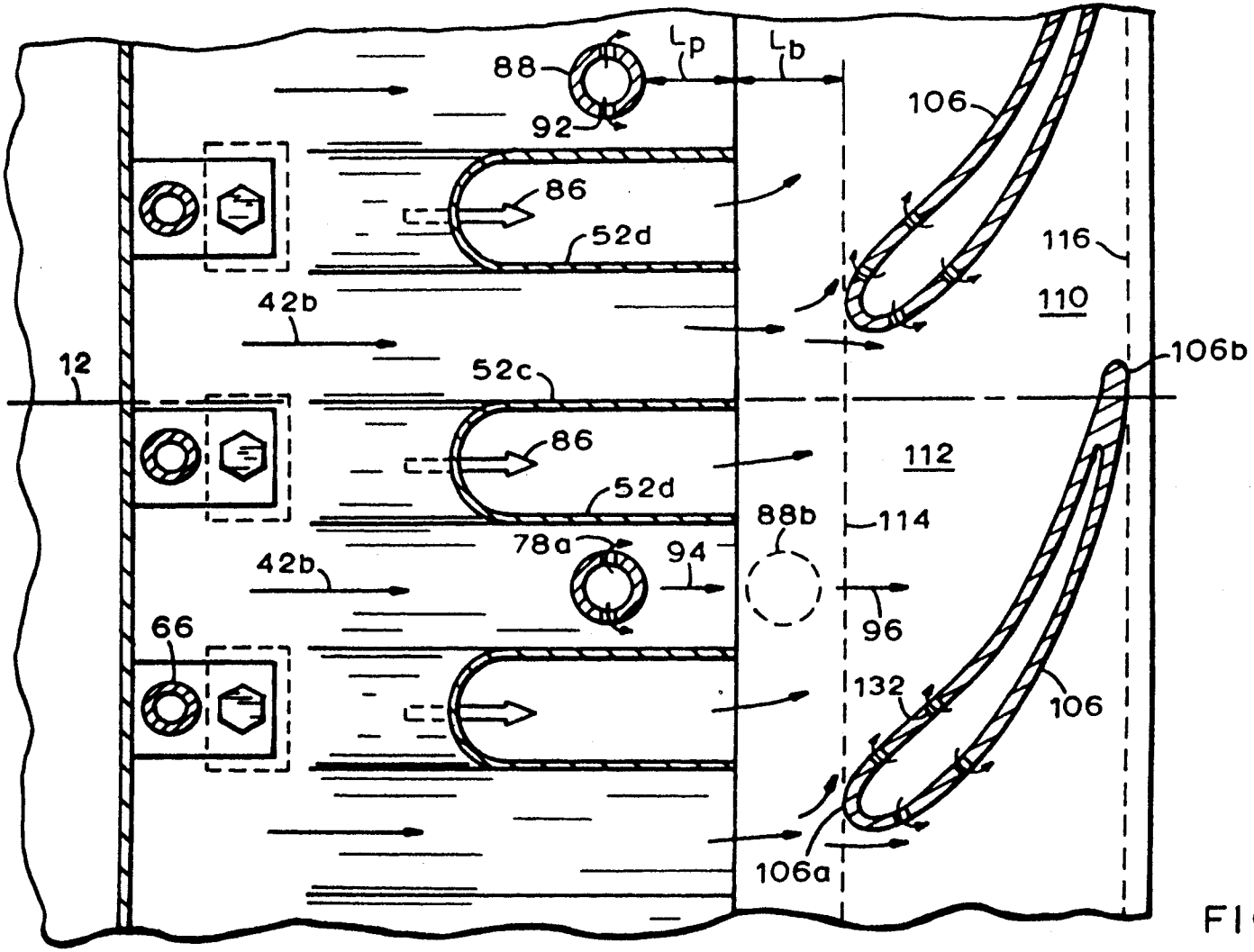
FIG. 5 is a circumferential sectional view of a portion of the combustor, and turbine nozzle disposed downstream therefrom, illustrated in FIG. 4 taken along arc line 5—5.

Referring again to FIG. 2, the combustion assembly 22 further includes the HP turbine nozzle 28 which has a plurality of conventional nozzle vanes 106 extending radially between outer and inner bands 108 and 110, respectively, which define flowpaths for the combustion gases 44. The vanes 106 are circumferentially spaced apart to define nozzle flow channels 112 as illustrated in FIG. 5 The turbine nozzle 28 also includes an annular inlet 114 defined at leading edges 106*a* of the vanes 106 and disposed in flow communication with the mixer hot and cold outlets 102*a* and 102*b* for receiving the pilot and main combustion gases 86 and 96, or, collectively, mixed combustion gases 44. An annular outlet 116 is defined at the trailing edges 106*b* of the vanes 106, from which the combustion gases 44 are channeled to the HPT 30. The nozzle flow channels 112 are preferably converging in a downstream direction for additionally quenching the combustion gases 44 channeled therethrough. The converging flow channels 112 accelerate the combustion gases 44, for thusly reducing static temperature thereof which effectively finally quenches the combustion gases 44.

As illustrated in FIGS. 4 and 5, the outer and inner cold chutes 52*c* and 54*c* are preferably longitudinally aligned with respective ones of the vane leading edges 106*a* for discharging the relatively cool main airflows 42*b* and 42*c* over the vane leading edges 106*a* for the cooling thereof. The outer and inner hot chutes 52*d* and 54*d* are preferably longitudinally aligned with the nozzle flow channels 112 between respective ones of the leading edges 106*a* for channeling the hot pilot combustion gases 56 between adjacent vanes 106. The fuel spraybars 88 are also preferably disposed in those cold chutes 52*c* and 54*c* longitudinally aligned with the nozzle flow channels 112 between adjacent ones of the vanes 106 so that the relatively hot main combustion gases 96 flow between adjacent vanes 106. In this way, neither the pilot combustion gases 56 nor the main combustion gases 96 flow directly over the vane leading edges 106*a* which would thereby require increased cooling of the vane 106 for obtaining acceptable life thereof. By channeling solely the relatively cool main airflows 42*b* and 42*c* over the vane leading edges 106*a*, cooling of the vanes 106 is thereby provided.

Referring again to FIG. 2, the outer and inner nozzle bands 108 and 110 preferably include outer and inner main combustion liners 108*a* and 110*a*, respectively extending upstream therefrom, and further upstream past the mixer outlet 102. The outer and inner main liners 108*a* and 110*a* are preferably formed integrally with the outer and inner bands 108 and 110, although they may be separate structures suitably joined thereto. The nozzle inlet 114 is preferably spaced downstream from the mixer outlet 102 to define a main combustion zone 118 having a burning length $L_b$ wherein the pilot combustion gases 86 ignite the main fuel/air mixtures 94 and mix with the main combustion gases 96.

The combustor reference velocities of the airflow channeled through a conventional carburetor are conventionally known. The reference velocity is generally constant over low to high power operation of the combustor, for example from idle to takeoff, and is represented by the weight, or mass, flowrate of the airflow divided by the density of the airflow and the flow area through the carburetor. As the weight flowrate of the airflow is increased for higher power operation of the combustor, the density thereof also increases for obtaining a generally constant reference velocity. The reference velocity in a conventional combustor is typically relatively low for allowing the fuel/air mixture to ignite and remain stable during operation of the combustor at all power levels. Accordingly, the carburetors 60 are preferably sized for obtaining a pilot reference velocity of the pilot airflow 42*a* channeled through the swirlers 62 which is less than an ignition reference velocity which allows the pilot fuel/air mixture 82 to ignite and the pilot combustion gases 86 to remain stable during operation. However, the main airflows 42*b* and 42*c* channeled through the cold chutes 52*c* and 54*c* are not limited by the ignition reference velocity since the main fuel/air mixtures 94 are ignited by the pilot combustion gases 86, and since the mixer outlet 102 acts as a flameholder for obtaining flame stability of the pilot and main combustion gases to prevent flameout.

Accordingly, the main airflows 42*b* and 42*c* preferably have a main reference velocity greater than, and preferably substantially greater than the ignition reference velocity for increasing mixing effectiveness and rate of combustion for decreasing $NO_x$ emissions. The cold chutes 52*c* and 54*c* may be predeterminedly sized in conjunction with the outer and inner diffusers 24*b* and 24*c* for obtaining such relatively high main reference velocity.

In a preferred embodiment of the present invention, the pilot reference velocity is in a range of about 30 to about 35 feet per second (9.1–10.7 meters per second) and the main reference velocity is in a range of about 140 to about 200 feet per second (42.7–61 meters per second). Such relatively high main reference velocity is a significant factor in obtaining a relatively low combustion residence time of less than about one (1) millisecond, which allows for a relatively short combustor 26 having a relatively short burning length $L_b$ of about 2.5 inches (6.4 cm).

The combustor 26 may be sized and operated in two different modes of operation, i.e. a lean-premixed mode and a rich-lean mode. In the lean-premixed mode, fuel is provided during lightoff and low power operation (e.g. idle) only by the carburetors 60, with no fuel being provided by the spraybars 88. The equivalence ratio of the pilot fuel/air mixture 82 is preferably about 1.0 and the equivalence ratio of the main fuel/air mixture 94 is zero. At intermediate power operation, such as at aircraft cruise, the equivalence ratios of the pilot fuel/air mixture 82 and the main fuel/air mixture 94 are in a range of about 0.6–0.8 (lean) for reducing $NO_x$ emissions. And, at high power operation, such as at aircraft takeoff, the equivalence ratios of the pilot and main mixtures 82, 94 are about 1.0.

In the rich-lean mode, fuel is provided during lightoff and low power operation again only by the carburetors 60, with no fuel being provided by the spraybars 88. The equivalence ratio of the pilot fuel/air mixture 82 is again preferably about 1.0 and the equivalence ratio of the main fuel/air mixture 94 is zero. However, at both intermediate and high power operation, the pilot fuel/air mixture 82 is preferably rich with an equivalence ratio greater than 1.0, and in one embodiment within a range of about 1.6 to about 1.8.

Preferably, no fuel is provided by the spraybars 88 at intermediate power operation resulting in a zero equivalence ratio of the main fuel/air mixture 94, which, therefore, includes only the main airflows 42*b*, 42*c*. The cold chutes 52*c*, 54*c* are sized for providing predetermined amounts of the main airflows 42*b*, 42*c* to rapidly mix with the pilot combustion gases 86 for generating a lean mixture thereof (i.e. the mixed combustion gases 44) having an equivalence ratio within a range of about 0.6 to about 0.8. In this way, axially staged rich-lean combustion can be obtained for significantly reducing $NO_x$ emissions during aircraft cruise.

At high power operation, the main fuel 78*a* is provided by the spraybars 88 with the main fuel/air mixture 94 being preferably lean and having an equivalence ratio in an exemplary range of about 0.6 to about 0.8. The resulting mixed combustion gases 44 will also be preferably lean with an exemplary equivalence ratio of about 0.7 to about 0.8.

In both the lean-premixed mode and the rich-lean mode, the preferred pilot and main references velocities described above may be used for reducing $NO_x$ emissions. In a fixed geometry combustor, having a total compressed airflow W provided through the carburetors 60 and cold chutes 52*c*, 54*c*, about 30% W is channeled through the former and about 70% W is channeled during the latter at all power conditions. In alternate embodiments of the invention, variable geometry carburetors may be used, for example, to control the pilot and main airflow splits for more fully controlling the equivalence ratios of the pilot and main fuel/air mixtures 82, 94 during the various power conditions.

Referring again to FIG. 2, the outer casing 68 is spaced radially outwardly from the outer pilot liner 52 and the nozzle outer band 108 to define an outer bypass channel 120. The inner casing 72 is spaced radially inwardly from the inner pilot liner 54 and the nozzle inner band 110 to define an inner bypass channel 122. The outer main liner 108*a* is spaced radially inwardly from the outer casing 68 to define an annular outer inlet 124 to the outer bypass channel 120 for receiving an outer bypass airflow portion 42*d* of the outer airflow 42*b*. The inner main liner 110*a* is spaced radially outwardly from the inner casing 72 to define an annular inner inlet 126 to the inner bypass channel 122 for receiving an inner bypass airflow portion 42*e* of the inner airflow 42*c*. A plurality of circumferentially spaced outer inlet vanes 128 and inner inlet vanes 130 define the outer and inner bypass inlets 124 and 126, respectively. The vanes 128, 130 are fixedly connected solely at their proximal ends to the outer and inner main liners 108*a* and 110*a*, respectively, so that their distal ends are allowed to slide axially against the outer and inner casings 68 and 72, respectively, for accommodating differential thermal movement.

Figure 6:
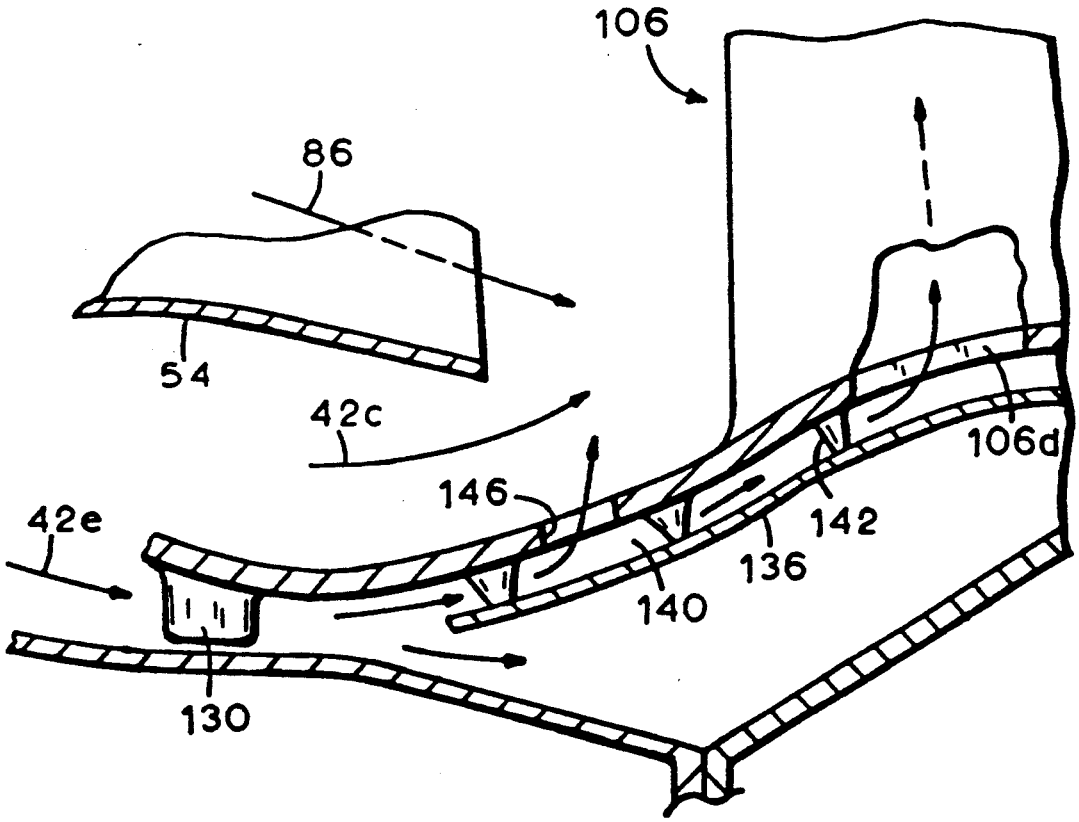
FIG. 6 is a longitudinal sectional view of an enlarged portion of a radially inner, downstream end of the combustor illustrated in FIG. 2 along with a portion of the turbine nozzle.

The outer and inner bypass channels 120 and 122 are effective for channeling the outer and inner bypass airflows 42*d* and 42*e* for cooling the turbine nozzle 28, as well as cooling the outer and inner main liners 108*a* and 110*a*. More specifically, the nozzle vanes 106, as illustrated in FIGS. 2 and 6 are hollow and include radially outer and inner vane inlets 106*c* and 106*d*, respectively, for receiving a portion of the outer and inner bypass airflow 42*d* and 42*e*, respectively. The vanes 106 include a plurality of vane outlets 132 as illustrated in FIG. 5, only a few of a substantial number of outlets 132 being shown, which extend through the vanes 106 for providing film cooling thereof, as is conventionally known.

Referring again to FIGS. 2 and 6, outer and inner cooling plates 134 and 136 are preferably spaced radially outwardly and inwardly over the outer and inner bands 108 and 110, respectively, to define outer and inner cooling passages 138 and 140, respectively. The cooling plates 134 and 136 are spaced from and secured to the bands 108 and 110 by a plurality of circumferentially and axially spaced tabs 142. The cooling plates 134 and 136 channel a portion of the outer and inner bypass airflows 42*d* and 42*e* through the cooling passages 138 and 140 for cooling the outer and inner main liners 108*a* and 110*a*, and for providing bypass airflow through the vanes 106 for the cooling thereof.

A plurality of conventional outer and inner dilution apertures 144 and 146, respectively preferably extend through the outer and inner main liners 108*a* and 110*a* in the main combustion zone 118. The dilution apertures 144 and 146 provide dilution air for additionally conventionally quenching the pilot and main combustion gases 86 and 96.

As illustrated in FIG. 2, the inner bypass channel 122 preferably includes a plurality of outlets 148 which provide a portion of the inner bypass airflow 42*e* through radially extending bores 150 for conventionally cooling the HPT 30.

Figure 7:
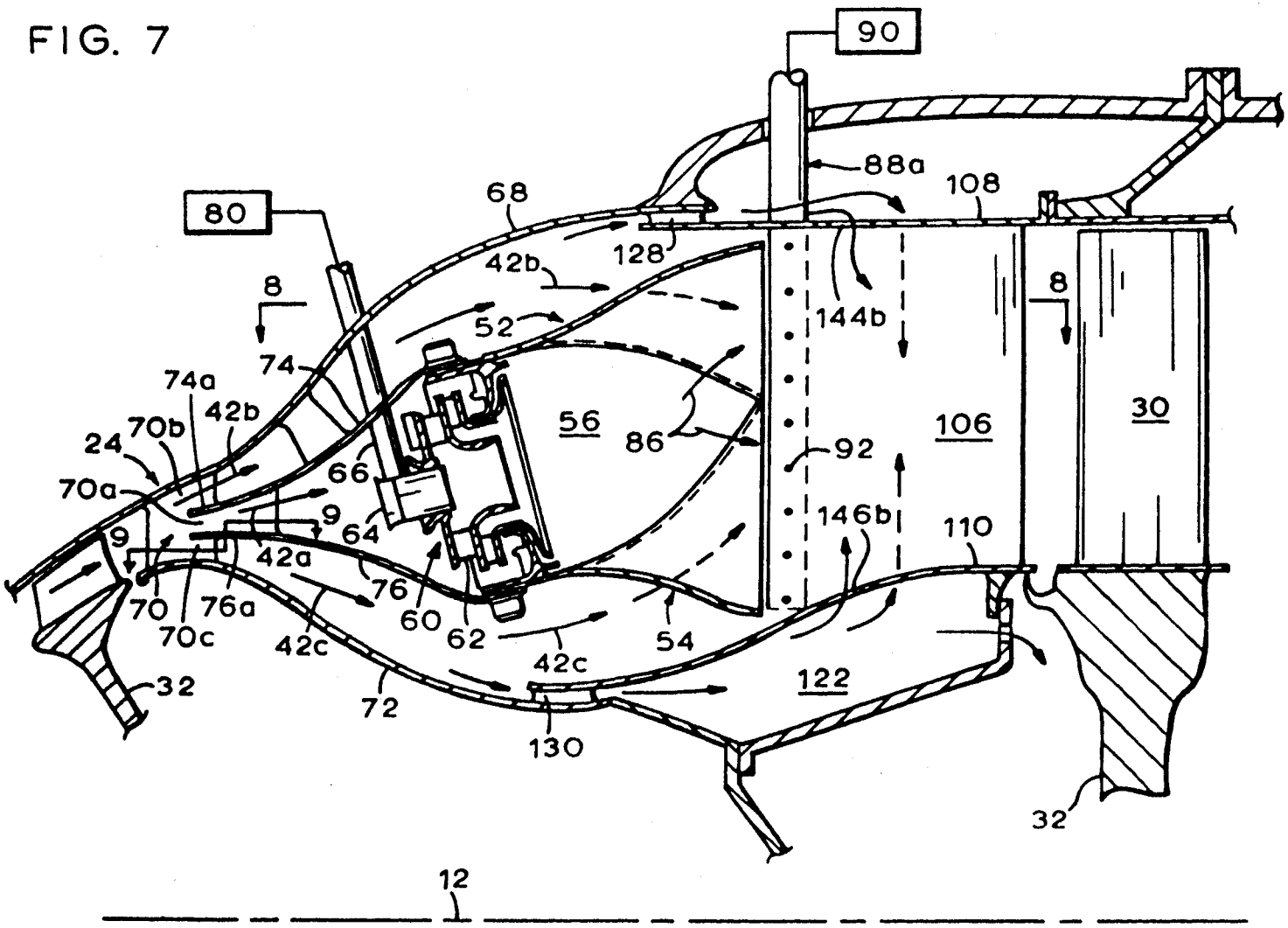
FIG. 7 is a longitudinal centerline sectional view, partly schematic, of an alternate embodiment of the combustion assembly illustrated in FIG. 2.
Figure 8:
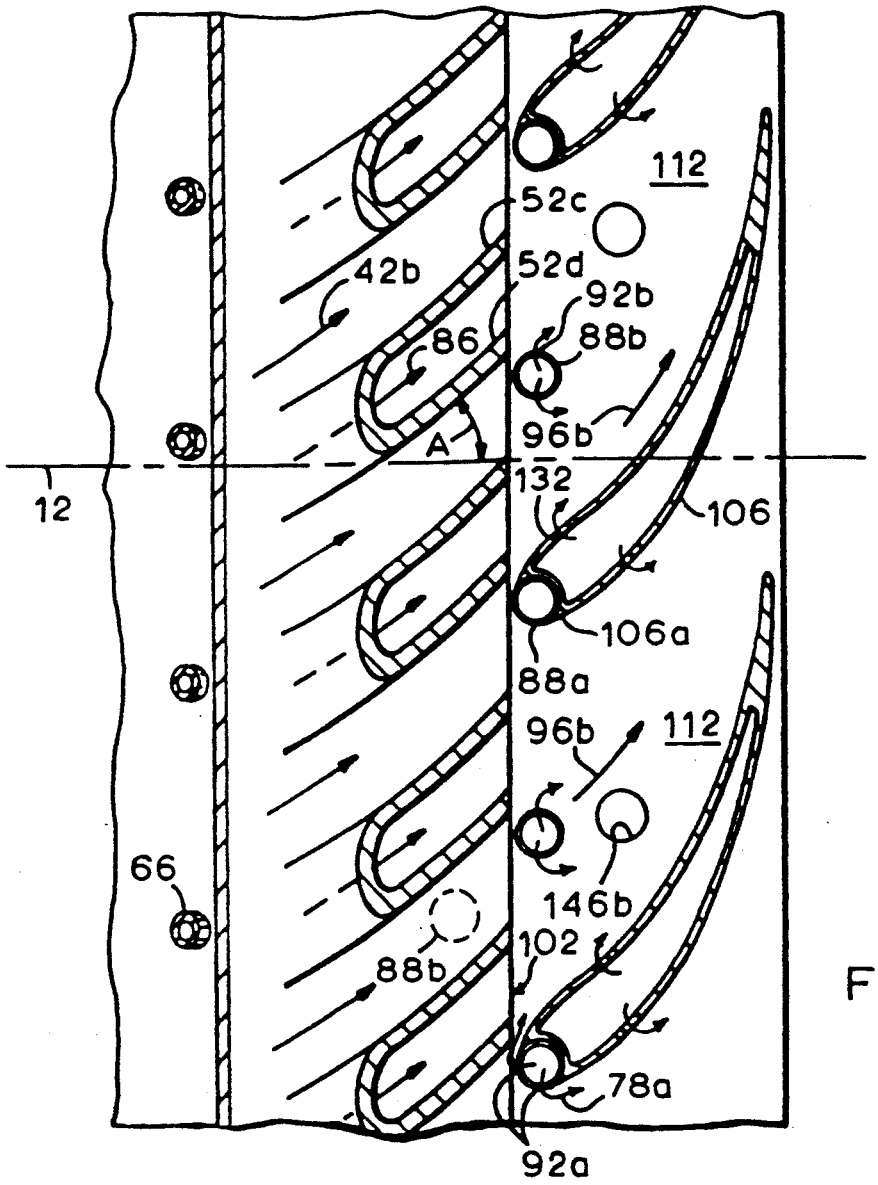
FIG. 8 is a circumferential sectional view of a portion of the combustor and turbine nozzle illustrated in FIG. 7 taken along line 8—8.
Figure 9:
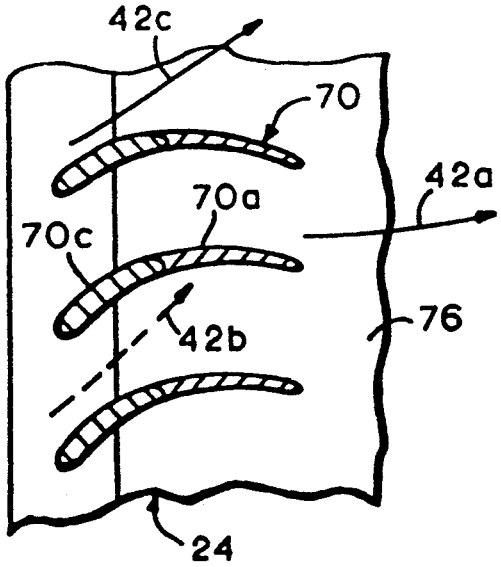
FIG. 9 is a circumferential sectional view of a portion of the diffuser illustrated in FIG. 7 taken along line 9—9.

Illustrated in FIGS. 7–9 is an alternate embodiment of the present invention. Whereas the cold chutes 52*c*, 54*c*, and the hot chutes 52*d*, 54*d*, in t embodiment of the invention described above, as illustrated in FIG. 5, for example, are aligned parallel with the longitudinal centerline axis 12, the cold chutes 52*c*, 54*c* and the hot chutes 52*d*, 54*d* in the embodiment illustrated in FIG. 8 are preferably aligned at an acute angle A of about 30°, for example, relative to the longitudinal centerline axis 12 for swirling the main airflows 42*b*, 42*c* and the pilot combustion gases 86 for increasing mixing thereof.

In this embodiment of the invention, the fuel spraybars 88 include first fuel spraybars 88*a* disposed in the leading edges 106*a* of the vanes 106, having fuel outlets 92*a* facing in opposing circumferential directions, and preferably partly in an upstream direction for increasing the mixing effectiveness between the main fuel 78*a* and the main airflows 42*b* and 42*c*. The leading edge fuel spraybars 88*a* cool the vane leading edge region reducing the use of cooling air in the vanes 106 and thus improve specific fuel consumption (SFC) and engine performance.

A plurality of circumferentially spaced second fuel spraybars 88*b* are preferably disposed circumferentially between adjacent ones of the first fuel spraybars 88*a*, and the first and second fuel spraybars 88*a* and 88*b* being longitudinally aligned with respective ones of the cold chutes 52*c* and 54*c*. In this way, the relatively cool main airflows 42*b* and 42*c* are mixed with the main fuel 78*a* discharged from the first fuel spraybar outlets 92*a* and the second fuel spraybar outlets 92*b* for generating the main fuel/air mixtures 94*b* directly in the nozzle channels 112.

This embodiment is practical only in the rich-lean mode wherein the pilot fuel-air mixture 82 is rich and the main fuel-air mixture 94 is lean as above described for obtaining a relatively fast rate of combustion for obtaining a short burning length in the nozzle channels 112. Otherwise, the channels 112 would require a relatively long axial length, if possible at all for containing combustion therein.

In one embodiment of the invention, the second fuel spraybars 88*b* are circumferentially aligned with the first fuel spraybars 88*a* at the same axial location relative to the longitudinal centerline 12. In alternate embodiments of the invention, the second fuel spraybars 88*b* are disposed upstream of the first fuel spraybars 88*a*, an exemplary one of which is shown in dashed line in FIG. 8, and may also be disposed upstream of the mixer outlet 102.

As shown in FIG. 8, the mixer outlet 102 is disposed substantially at the leading edges 106*a* of the vanes 106 and not spaced upstream therefrom as in the FIG. 2 embodiment. However, the mixer outlet 102 could be disposed upstream of the vane leading edges 106*a* in the FIG. 8 embodiment of the invention just as in the FIG. 2 embodiment of the invention, and in such an embodiment, the second fuel spraybars 88*b* may be disposed between the mixer outlet 102 and the first fuel spraybars 88*a* as illustrated in dashed line 88*b* in FIG. 5.

As illustrated in FIGS. 7 and 8, conventional outer and inner dilution apertures 144*b* and 146*b* extend through the outer and inner bands 108 and 110 for providing the dilution air into the nozzle channels 112.

In this embodiment wherein the cold and hot chutes 52*c* and 52*d* are inclined at the acute angle A relative to the longitudinal centerline axis 12, the OGVs 70 of the diffuser 24 as illustrated in FIGS. 7 and 9 are correspondingly configured for additionally swirling the outer and inner main airflows 42*b* and 42*c* while deswirling the pilot airflow 42*a*. More specifically, each of the OGVs 70 includes a central portion 70*a*, and outer and inner portions 70*b* and 70*c*, respectively. The central portion 70*a* is axially longer than the substantially identical outer and inner portions 70*b* and 70*c* for deswirling the pilot airflow 42*a*, while swirled outer and inner main airflows 42*b* and 42*c* are provided from the relatively shorter outer and inner portions 70*b* and 70*c*. By so swirling the main airflows 42*b*, 42*c* into the HPN 28, less turning is required from the vanes 106, so relatively short vanes 106 may be used.

Also in this embodiment, the outer and inner pilot liners 52, 54, dome 58 and swirlers 62 are fixedly supported to the outer and inner casings 68, 72 by the outer and inner cowls 74 and 76 fixedly joined to the OGVs 70. The fuel injectors 64 are conventionally axially and radially slidably joined to the swirlers 62.

While there have been described herein what are considered to be preferred embodiments of the present invention, other modifications of the invention shall be apparent to those skilled in the art from the teachings herein, and it is, therefore, desired to be secured in the appended claims all such modifications as fall within the true spirit and scope of the invention.

For example, in alternate embodiments of the invention, the swirler 62 could be a variable area swirler for selectively varying the amount of pilot airflow 42*a* channeled therethrough for further controlling the reference velocity thereof during the various modes of operation.

Accordingly, what is desired to be secured by Letters Patent of the United States is the invention as defined and differentiated in the following claims.

We claim:

1. A combustion assembly for receiving compressed airflow from a compressor in a gas turbine engine, said assembly including a combustor comprising:

an outer pilot liner having an upstream end and a downstream end and including a serpentine circumference having spaced peaks and valleys;

an inner pilot liner having an upstream end and a downstream end and including a serpentine circumference having peaks and valleys, said inner pilot liner being spaced from said outer pilot liner to define a pilot combustion zone;

said outer and inner pilot liner downstream ends defining a mixer outlet wherein said outlet pilot liner valleys are radially aligned with an disposed adjacent to respective ones of said inner pilot liner peaks;

an annular dome joining together said inner and outer pilot liner upstream ends;

a plurality of carburetors joined to said dome and circumferentially spaced from each other for providing a pilot fuel/air mixture into said pilot combustion zone for generating pilot combustion gases;

each of said outer and inner pilot liners being in the form of a lobed mixer having outer and inner cold chutes, respectively, in flow communication with a main airflow portion of said compressed airflow, and outer and inner hot chutes, respectively, defining said pilot combustion zone for channeling said pilot combustion gases;

a plurality of circumferentially spaced fuel spraybars disposed downstream from said carburetors, each aligned radially with said cold chutes for selectively injecting main fuel into said main airflow for providing a main fuel/air mixture ignitable by said pilot combustion gases for generating main combustion gases, said main fuel/air mixture being mixable with said pilot combustion gases downstream of said mixer outlet for forming mixed combustion gases;

fuel control means for controlling pilot fuel channeled through said carburetors and said main fuel channeled through said fuel spraybars, said fuel control means being effective for channeling said main fuel to said fuel spraybars for generating a lean main fuel/air mixture; and a turbine nozzle having:

a plurality of nozzle vanes extending radially between outer and inner bands, and being circumferentially spaced apart to define nozzle flow channels;

an annular inlet defined at leading edges of said vanes and disposed in flow communication with said pilot and main combustion gases;

an annular outlet defined at trailing edges of said vanes; and said flow channels being converging in a downstream direction for quenching said pilot and main combustion gases channeled therethrough.

2. A combustion assembly according to claim 1 wherein said fuel control means are effective for channeling said pilot fuel to said carburetors for generating a lean pilot fuel/air mixture.

3. A combustion assembly according to claim 1 wherein said fuel control means are effective for channeling said pilot fuel to said carburetors for generating a rich pilot fuel/air mixture, and for preventing flow of said main fuel to said spraybars.

4. A combustion assembly according to claim 1 wherein said fuel spraybars are disposed upstream of said mixer outlet to define therewith a premixing zone for premixing said main fuel from said spraybars with said main airflow flowable in said cold chutes, and extend radially through said cold chutes.

5. A combustion assembly according to claim 4 wherein said outer and inner pilot liners are effective for prevaporizing said main fuel/air mixture upon flowing downstream from said mixer outlet.

6. A combustion assembly according to claim 4 wherein said fuel spraybars extend radially inwardly from an outer casing of said combustor through said outer and inner cold chutes.

7. A combustion assembly according to claim 6 wherein said fuel spraybars include a plurality of radially spaced fuel outlets facing in a circumferential direction for increasing mixing between said main fuel flowable therethrough and said main airflow flowable thereover.

8. A combustion assembly according to claim 7 wherein said outer and inner cold chutes are longitudinally aligned with said vane leading edges, and said outer and inner hot chutes are longitudinally aligned with said nozzle flow channels between respective ones of said leading edges.

9. A combustion assembly according to claim 8 wherein:

said nozzle outer and inner bands include outer and inner main liners extending upstream therefrom and upstream of said mixer outlet;

said nozzle inlet is spaced downstream from said mixer outlet to define a main combustion zone having a burning length wherein said pilot combustion gases ignite said main fuel/air mixture and mix with said main combustion gases.

10. A combustion assembly according to claim 9 wherein:

said pilot fuel/air mixture has an equivalence ratio within a range of about 1.6 to about 1.8;

said main fuel/air mixture has an equivalence ratio of zero; and said mixed combustion gases have an equivalence ratio within a range of about 0.6 to about 0.8.

11. A combustion assembly according to claim 9 wherein:

said carburetors are sized for obtaining a pilot reference velocity of said pilot fuel/air mixture less than an ignition reference velocity allowing said pilot fuel/air mixture to ignite; and said cold chutes are sized for channeling said main fuel/air mixture at a main reference velocity greater than said ignition reference velocity.

12. A combustion assembly according to claim 11 wherein said pilot reference velocity is in a range of about 30 to about 35 feet per second (about 9.1 to about 10.7 meters per second) and said main reference velocity is in a range of about 140 to about 200 feet per second (about 42.7 to about 61 meters per second).

13. A combustion assembly according to claim 9 further including:

an annular outer casing spaced radially outwardly from said outer pilot liner and said nozzle outer band to define an outer bypass channel;

an annular inner casing spaced radially inwardly from said inner pilot liner and said nozzle inner band to define an inner bypass channel;

said outer main liner being spaced radially inwardly from said outer casing to define an outer inlet to said outer bypass channel for receiving an outer bypass airflow portion of said compressed airflow;

said inner main liner being spaced radially outwardly from said inner casing to define an inner inlet to said bypass channel for receiving an inner bypass airflow portion of said compressed airflow; and said outer and inner bypass channels being effective for channeling said outer and inner bypass airflows for cooling said turbine nozzle.

14. A combustion assembly according to claim 13 wherein said nozzle vanes are hollow and include radially outer and inner inlets for receiving a portion of said outer and inner bypass airflows, respectively, and a plurality of outlets extending through said vanes for providing film cooling of said vanes.

15. A combustion assembly according to claim 14 further including outer and inner cooling plates spaced radially outwardly and inwardly over said outer and inner nozzle bands, respectively, to define outer and inner cooling passages, respectively, for cooling said outer and inner main liners and channeling said bypass airflow to said vanes.

16. A combustion assembly according to claim 15 further including:

a plurality of outer dilution apertures extending through said outer main liner for channeling a portion of said outer bypass airflow as outer dilution air into said main combustion zone; and a plurality of inner dilution apertures extending through said inner main liner for channeling a portion of said inner bypass airflow as inner dilution air into said main combustion zone.

17. A combustion assembly according to claim 9 wherein said cold and hot chutes are aligned parallel to a longitudinal axis of said combustor.

18. A combustion assembly according to claim 9 wherein said cold and hot chutes are aligned at an acute angle relative to a longitudinal axis of said combustor for swirling said main fuel/air mixture.

19. A combustion assembly according to claim 8 wherein said fuel spraybars include first fuel spraybars disposed in said leading edges of said nozzle vanes.

20. A combustion assembly according to claim 19 further including a plurality of second fuel spraybars disposed circumferentially between said first fuel spraybars, and said first and second fuel spraybars being longitudinally aligned with said cold chutes.

21. A combustion assembly according to claim 20 wherein said second fuel spraybars are circumferentially aligned with said first fuel spraybars.

22. A combustion assembly according to claim 20 wherein said second fuel spraybars are disposed upstream of said first fuel spraybars.

23. A combustion assembly according to claim 22 wherein said second fuel spraybars are disposed upstream of said mixer outlet.

24. A combustion assembly according to claim 22 wherein said second fuel spraybars are disposed between said mixer outlet and said first fuel spraybars.

25. A combustion assembly according to claim 20 wherein said mixer outlet is disposed adjacent to said nozzle inlet.

26. A combustion assembly according to claim 20 wherein said cold and hot chutes are aligned at an acute angle to a longitudinal centerline axis of said combustor for swirling said main fuel/air mixture.

27. A combustion assembly according to claim 26 further including:

a plurality of circumferentially spaced outlet guide vanes disposed in flow communication with said compressor for receiving said compressed airflow therefrom;

an outer cowl having a leading edge joined to said outlet guide vanes, and a trailing edge joined to said outer pilot liner at said dome;

an inner cowl having a leading edge joined to said outlet guide vanes, and a trailing edge joined to said inner pilot liner at said dome; and said outer and inner cowl leading edges being spaced from each other and said outer and inner casings to define a central diffuser for channeling a pilot portion of said compressed airflow to said carburetors, and outer and inner channels for channeling said main airflow over said outer and inner pilot liners and through said cold chutes.

28. A combustion assembly according to claim 27 wherein said outlet guide vanes each have a central portion and outer and inner portions, with said central portion being axially longer than said outer and inner portions for deswirling said pilot airflow and providing swirled main airflow from said outer and inner portions.

* * * * *